US005520088A

United States Patent [19]

Dixen

[11] Patent Number: 5,520,088

[45] Date of Patent: May 28, 1996

[54] AXIAL PISTON MACHINE

[75] Inventor: Carl C. Dixen, Sydals, Denmark

[73] Assignee: Danfoss A/S, Nordborg, Denmark

[21] Appl. No.: 411,612

[22] PCT Filed: Oct. 27, 1993

[86] PCT No.: PCT/DK93/00342

§ 371 Date: Apr. 6, 1995

§ 102(e) Date: Apr. 6, 1995

[87] PCT Pub. No.: WO94/11633

PCT Pub. Date: May 26, 1994

[30] Foreign Application Priority Data

Nov. 6, 1992 [DE] Germany ..... 42 37 506.1

[51] Int. Cl.[6] ..... F04B 1/20; F01B 3/00

[52] U.S. Cl. ..... 92/71; 91/499

[58] Field of Search ..... 92/71, 70, 12.2, 92/187; 91/505, 506, 499; 417/222.1

[56] References Cited

U.S. PATENT DOCUMENTS

| | | | |
|---|---|---|---|
| 2,925,046 | 2/1960 | Budzich | 91/507 |
| 3,246,577 | 4/1966 | Macintosh | 91/507 |
| 4,111,103 | 9/1978 | Mauch | 92/57 |
| 4,602,554 | 7/1986 | Wagenseil et al. | 91/506 X |
| 4,620,475 | 11/1986 | Watts | 91/499 |
| 4,637,293 | 1/1987 | Yamaguchi et al. | 91/499 X |
| 4,771,676 | 9/1988 | Matsumoto et al. | 92/12.2 X |

FOREIGN PATENT DOCUMENTS

| | | | |
|---|---|---|---|
| 3940441 | 6/1991 | Germany | 91/499 |
| 1353931 | 11/1987 | U.S.S.R. | 92/71 |
| 924768 | 5/1963 | United Kingdom | 92/71 |

*Primary Examiner*—John E. Ryznic

*Attorney, Agent, or Firm*—Lee, Mann, Smith, McWilliams, Sweeney & Ohlson

[57] ABSTRACT

An axial piston machine (1) is described, having a cylinder body (2) that is rotatable relative to a wobble plate (3) and in which several pistons (6) are arranged so as to be axially displaceable, the pistons being supported on a sliding-contact face (4) of the wobble plate 930 by means of slider shoes (9) articulated at the free ends of the pistons, wherein a pressure element (13) holding the slider shoes (9) on the sliding-contact face (4) is provided. It is desirable to reduce internal leakage in an axial piston machine of that kind. For that purpose, a wave spring element (16) is provided between each slider shoe (9) and the pressure element (13).

5 Claims, 1 Drawing Sheet

AXIAL PISTON MACHINE

Figure 1:
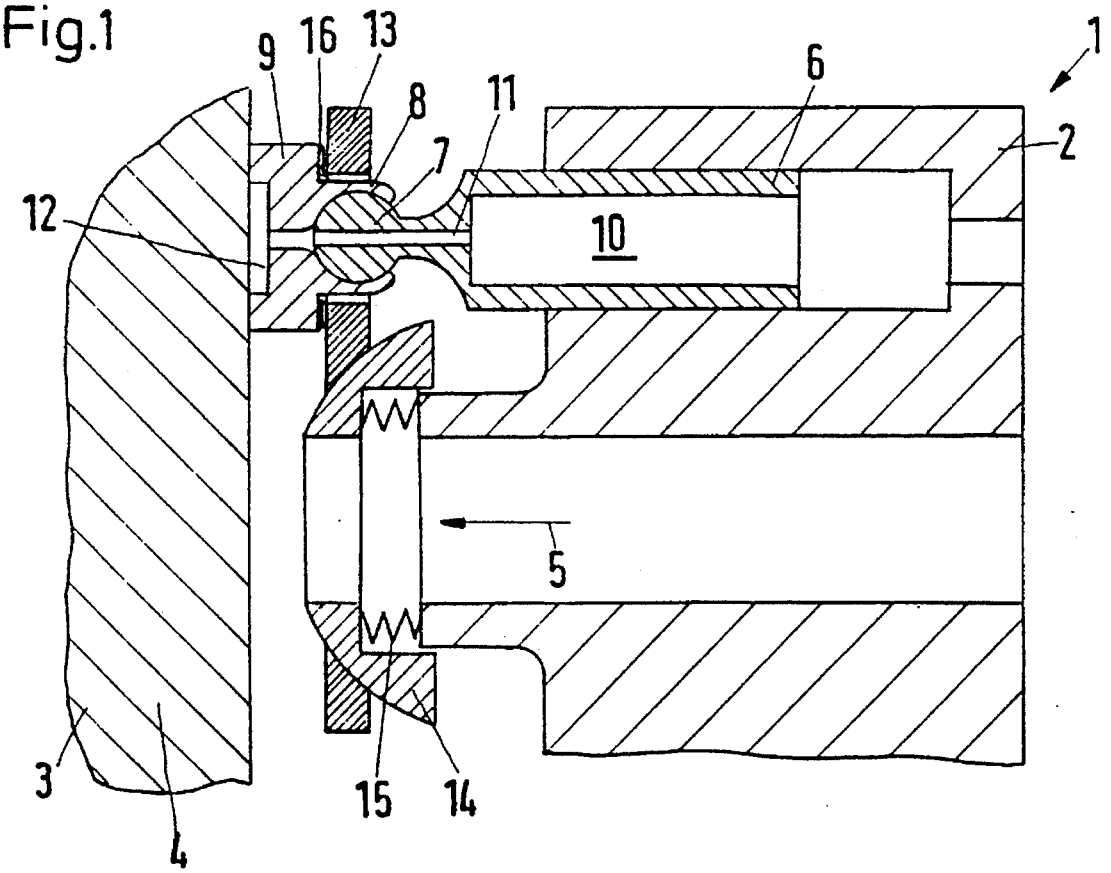

The invention relates to an axial piston machine having a cylinder body that is rotatable relative to a wobble plate and in which several pistons are arranged so as to be axially displaceable, the pistons being supported on a sliding-contact face of the wobble plate by means of slider shoes articulated at the free ends of the pistons, wherein a pressure element holding the slider shoes on the sliding-contact face is provided.

Axial piston machines of that kind can be used as pumps or as motors. One area of use is the drive of vehicles, in which the axial piston machine forms part of the drive system. In such vehicles it has been found that the blocking action of such an machine, that is, the "motor braking action" is inadequate in many cases. Consequently, such a vehicle starts to move by itself when standing on a sloping surface although the axial piston machine is in its neutral position, that is, should actually block the drive.

This phenomenon can be attributed to internal leaks in the drive system; a large part of these internal leaks occurs in the axial piston machine.

The problem of internal leaks in axial piston machines is well known. DE 37 25 979 C2, for example, which discloses an axial piston machine of the kind mentioned in the introduction, describes an attempt to prevent canting by matching the slider shoe bearing surface to the corresponding counter-surface of the wobble plate. DE 28 04 912 C2 provides a retaining ring which holds the slider shoes down at the radially outer end of the wobble plate on the sliding-contact face of the wobble plate. U.S. Pat. No. 3,382,793 discloses an attempt to guarantee contact by means of a holding-down plate.

All the known solutions do improve internal sealing of the axial piston machine, but essentially they only prevent the slider shoes from canting relative to the sliding-contact face. They fail in particular in the axial piston machine during the transition from the pressure stroke to the suction stroke (in the case of the pump) or during the transition from the working stroke to the supply stroke (in the case of the motor) or vice versa. During such a transition, the force relationships are indeterminate, that it, neither the forces acting from the slider shoe side nor the forces acting from the wobble plate side on the contact area between the slider shoe and the sliding-contact face are substantial enough to guarantee a reliable seat of the slider shoes on the sliding-contact face. Since a part of the slider shoes is always located in a such a region, as before there are unsealed points here which lead to internal leaks.

The invention is therefore based on the problem of reducing the internal leakage in an axial piston machine.

In an axial piston machine of the kind mentioned in the introduction, this problem is solved in that a spring element is provided between each slider shoe and the pressure element.

The force acting on the slider shoe, which causes the slider shoe to bear on the sliding-contact face, is therefore no longer produced directly by the pressure element, but by way of a spring element which is inserted with a certain prestress between the pressure element and the slider shoe. This spring element is prestressed sufficiently so that it itself exerts the necessary force on the slider shoe even at the maximum possible spacing between the slider shoe and the pressure element, so that the slider shoe rests reliably on the sliding-contact face. Hydraulic fluid is therefore largely prevented from escaping between the slider shoe and the sliding-contact face so that internal leakage can be kept to a minimum. The only hydraulic fluid to escape is that required for lubrication of the contact face between the slider shoe and the sliding face, and this is only an extremely small amount. Since the slider shoe is held permanently under pressure on the sliding-contact face, there is no interruption in the lubrication, as could occur previously when the slider shoe lifted off the sliding-contact face. Wear is accordingly quite considerably reduced. The service life is further prolonged in that an inevitable abrasion of the slider shoes and of the sliding-contact face of the wobble plate can be compensated. The spring element always guides the slider shoe into contact with the sliding-contact face regardless of abrasion, without the pressure element having to be correspondingly adjusted. A further advantage of the spring element is a reduction in manufacturing costs. The slider shoes can be manufactured with a relatively low degree of accuracy. In particular, tolerances in thickness can be greater. Variations of individual slider shoes among each other are compensated for by the spring element. The sliding-contact face too can be manufactured with somewhat less precision. Variations from the form of a plane can be tolerated provided that the force of the spring element is still sufficient to press the slider shoes permanently against the sliding-contact face.

In a preferred construction, the spring element is of annular construction and surrounds the slider shoe for a part of its length. The slider shoe therefore has the force of the spring acting on it all round, so that it is relatively uniformly stressed over its entire contact face. Canting of the slider shoe relative to the sliding-contact face is therefore virtually excluded.

In an especially preferred construction, the spring element is in the form of a wave spring. Such a wave spring requires only a small overall height so that even existing axial piston machines can be retrofitted with virtually no further changes. The spring is in the form of a deformed annular disc, that is, an annular disc which is not even in the circumferential direction but undulates. In a simple manner it allows spring forces to be distributed uniformly to several points in the circumferential direction of the slider shoe.

The wave spring here advantageously has at least three waves. With more than two waves there is a corresponding number of bearing points both on the pressure element and on the slider shoe. This is able to prevent canting of the slider shoe due to uneven force application by the spring.

It is especially favourable for the wave spring to have just three waves. In that case, wobbling of the spring in the event of insufficient prestress, and consequently an uneven force application of the slider shoe, can also be avoided.

Figure 2:
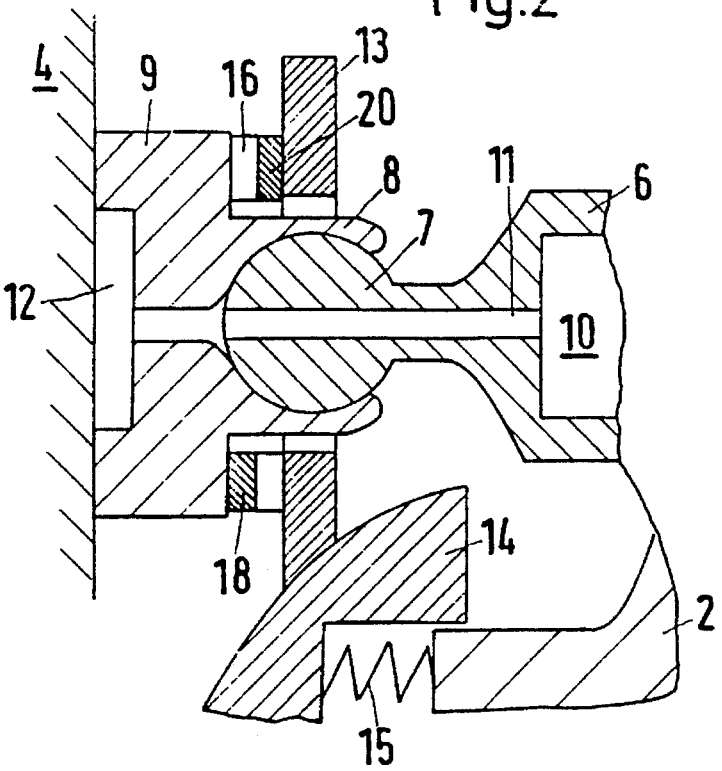
Figure 3:
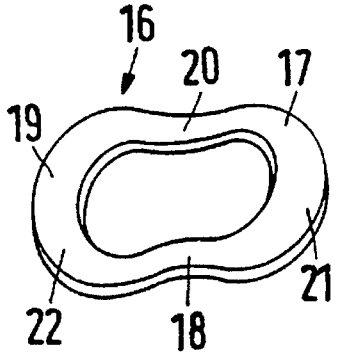

The invention is described hereinafter with reference to a preferred embodiment and in conjunction with the drawing, in which FIG. 1 is a diagrammatic view of a part of an axial piston machine, FIG. 2 is an enlarged fragmentary view from FIG. 1, and FIG. 3 shows a wave spring.

An axial piston machine 1 comprises a cylinder body 2 which is arranged to rotate relative to a wobble plate 3. Only a sliding-contact face 4 of the wobble plate 3 is shown, and in this particular instance is inclined to an axis 5. The invention is nevertheless also applicable to surfaces that are not inclined.

A plurality of pistons are arranged so as to be axially displaceable in the cylinder body 2. At their free end, that is to say, at the end which projects from the cylinder body 2, the pistons 6 terminate in a ball-like member 7 which in its turn is received in a correspondingly spherical seat 8 of a slider shoe 9. The slider shoe 9 is therefore pivotally mounted at the free end of the piston 6. The piston 6 is hollow, that is, it has an inner space 10, which is connected by way of a throttle channel 11 to a counter-pressure region 12 of the slider shoe 9. A very small amount of hydraulic fluid is applied to the sliding-contact face 4 of the wobble plate by way of the counter-pressure region 12. The resulting film of liquid allows low-friction sliding of the slider shoe 9 on the sliding-contact face 4. Moreover, the hydraulic fluid in the counter-pressure region 12 relieves the slider shoe 9 of hydrostatic stress, which has the effect of further reducing friction.

Also provided is a pressure plate 13, which is secured by way of a spherical bearing 14 to the cylinder body 2. Between the spherical bearing 14 and the cylinder body 2 there is a compression spring 15 which urges the pressure plate 13 towards the wobble plate 3.

Between the pressure plate 13 and the slider shoe 9 there is a spring element 16. By way of the spring element 16, which is stressed between the slider shoe 9 and the pressure plate 13, the pressure plate 13 exerts a permanent force on the slider shoe 9, so that the slider shoe 9 lies under permanent pressure against the sliding face 4 of the wobble plate 3.

The spring element 16 is able to compensate for slight differences in the thickness of the slider shoes 9. Furthermore, it can ensure that the slider shoes 9 always lie relatively tightly against the sliding face 4 even if there are minor unevenness in the sliding face 4.

The spring element 16 is in the form of a wave spring, that is to say, in plan view it has the shape of an annular disc. In the circumferential direction this wave spring is not, however, uniform, but has three peaks 17 to 19 and three troughs 20 to 22. There are therefore three bearing points, uniformly distributed in the circumferential direction, on both the pressure plate 13 and the slider shoe 9, so that the entire slider shoe 9 is pressurized with a pressure distributed uniformly over its base face.

The spring 16 surrounds the slider shoe 9 for a part of its length in the manner of a ring. It extends over the part of the slider shoe 9 which also contains the seat 8. In this region the slider shoe 9 is of reduced diameter so that the spring element 16 lies on the step that leads over to the larger diameter.

I claim:

1. An axial piston machine comprising a cylinder body that is rotatable relative to a wobble plate and in which several pistons are arranged so as to be axially displaceable, the pistons being supported on a sliding-contact face of the wobble plate by means of slider shoes articulated at the free ends of the pistons, and having a pressure element holding the slider shoes on the sliding-contact face, a spring element being located between each slider shoe and the pressure element.

2. An axial piston machine according to claim 1, in which the spring element is of annular construction and surrounds the slider shoe for a part of its length.

3. An axial piston machine according to claim 2, in which the spring element is in the form of a wave spring.

4. An axial piston machine according to claim 3, in which the wave spring has at least three waves.

5. An axial piston machine according to claim 4, in which the wave spring has just three waves.

* * * * *